US006213225B1

(12) United States Patent
Chen

(10) Patent No.: US 6,213,225 B1
(45) Date of Patent: Apr. 10, 2001

(54) FORCE-BALANCED ROLLER-CONE BITS, SYSTEMS, DRILLING METHODS, AND DESIGN METHODS

(75) Inventor: Shilin Chen, Dallas, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 0 days.

(21) Appl. No.: 09/387,737

(22) Filed: Aug. 31, 1999

Related U.S. Application Data

(60) Provisional application No. 60/098,466, filed on Aug. 31, 1998.

(51) Int. Cl.[7] ..... E21B 10/16

(52) U.S. Cl. ..... 175/57; 76/108.2; 175/331; 175/378

(58) Field of Search ..... 175/331, 57, 353, 175/355, 356, 378; 76/108.2, 108.4

(56) References Cited

U.S. PATENT DOCUMENTS

| | | | | |
|---|---|---|---|---|
| 1,209,299 | * | 12/1916 | Hughes | 175/333 |
| 1,263,802 | * | 4/1918 | Reed | 175/340 |
| 1,394,769 | * | 10/1921 | Sorensen | 175/336 |
| 4,187,922 | | 2/1980 | Phelps | 175/374 |
| 4,393,948 | | 7/1983 | Fernandez | 175/374 |
| 4,627,276 | * | 12/1986 | Burgess et al. | 175/39 |
| 4,815,342 | * | 3/1989 | Brett et al. | 76/108 A |
| 5,197,555 | | 3/1993 | Estes | 175/431 |
| 5,216,917 | * | 6/1993 | Detournay | 175/39 |
| 5,305,836 | * | 4/1994 | Holbrook et al. | 175/39 |
| 5,704,436 | | 1/1998 | Smith et al. | 175/27 |
| 5,767,399 | | 6/1998 | Smith et al. | 73/152.11 |
| 5,794,720 | | 8/1998 | Smith et al. | 175/40 |

FOREIGN PATENT DOCUMENTS 2241266 8/1991 (GB) .

* cited by examiner

*Primary Examiner*—Hoang Dang
(74) *Attorney, Agent, or Firm*—Groover & Associates; Robert Groover; Betty Formby

(57) ABSTRACT

Roller cone drilling wherein the bit optimization process equalizes the downforce (axial force) for the cones (as nearly as possible, subject to other design constraints). Bit performance is significantly enhanced by equalizing downforce.

12 Claims, 8 Drawing Sheets

FORCE-BALANCED ROLLER-CONE BITS, SYSTEMS, DRILLING METHODS, AND DESIGN METHODS

CROSS-REFERENCE TO OTHER APPLICATION

This application claims priority from U.S. provisional application No. 60/098,466 filed Aug. 31 1998, which is hereby incorporated by reference.

BACKGROUND AND SUMMARY OF THE INVENTION

The present invention relates to down-hole drilling, and especially to the optimization of drill bit parameters.

Background: Rotary Drilling

Oil wells and gas wells are drilled by a process of rotary drilling, using a drill rig such as is shown in FIG. 10. In conventional vertical drilling, a drill bit 10 is mounted on the end of a drill string 12 (drill pipe plus drill collars), which may be miles long, while at the surface a rotary drive (not shown) turns the drill string, including the bit at the bottom of the hole.

Two main types of drill bits are in use, one being the roller cone bit, an example of which is seen in FIG. 11. In this bit a set of cones 16 (two are visible) having teeth or cutting inserts 18 are arranged on rugged bearings on the arms of the bit. As the drill string is rotated, the cones will roll on the bottom of the hole, and the teeth or cutting inserts will crush the formation beneath them. (The broken fragments of rock are swept uphole by the flow of drilling fluid.) The second type of drill bit is a drag bit, having no moving parts, seen in FIG. 12.

There are various types of roller cone bits: insert-type bits, which are normally used for drilling harder formations, will have teeth of tungsten carbide or some other hard material mounted on their cones. As the drill string rotates, and the cones roll along the bottom of the hole, the individual hard teeth will induce compressive failure in the formation. The bit's teeth must crush or cut rock, with the necessary forces supplied by the "weight on bit" (WOB) which presses the bit down into the rock, and by the torque applied at the rotary drive.

Background: Drill String Oscillation

The individual elements of a drill string appear heavy and rigid. However, in the complete drill string (which can be more than a mile long), the individual elements are quite flexible enough to allow oscillation at frequencies near the rotary speed. In fact, many different modes of oscillation are possible. (A simple demonstration of modes of oscillation can be done by twirling a piece of rope or chain: the rope can be twirled in a flat slow circle, or, at faster speeds, so that it appears to cross itself one or more times.) The drill string is actually a much more complex system than a hanging rope, and can oscillate in many different ways; see WAVE PROPAGATION IN PETROLEUM ENGINEERING, Wilson C. Chin, (1994).

The oscillations are damped somewhat by the drilling mud, or by friction where the drill pipe rubs against the walls, or by the energy absorbed in fracturing the formation: but often these sources of damping are not enough to prevent oscillation. Since these oscillations occur down in the wellbore, they can be hard to detect, but they are generally undesirable. Drill string oscillations change the instantaneous force on the bit, and that means that the bit will not operate as designed. For example, the bit may drill oversize, or off-center, or may wear out much sooner than expected. Oscillations are hard to predict, since different mechanical forces can combine to produce "coupled modes"; the problems of gyration and whirl are an example of this.

Background: Optimal Drilling with Various Formation Types

There are many factors that determine the drillability of a formation. These include, for example, compressive strength, hardness and/or abrasiveness, elasticity, mineral content (stickiness), permeability, porosity, fluid content and interstitial pressure, and state of underground stress.

Soft formations were originally drilled with "fish-tail" drag bits, which sheared the formation. Fish-tail bits are obsolete, but shear failure is still very useful in drilling soft formations. Roller cone bits designed for drilling soft formations are designed to maximize the gouging and scraping action, in order to exploit both shear and compressive failure. To accomplish this, cones are offset to induce the largest allowable deviation from rolling on their true centers. Journal angles are small and cone-profile angles will have relatively large variations. Teeth are long, sharp, and widely-spaced to allow for the greatest possible penetration. Drilling in soft formations is characterized by low weight and high rotary speeds.

Hard formations are drilled by applying high weights on the drill bits and crushing the formation in compressive failure. The rock will fail when the applied load exceeds the strength of the rock. Roller cone bits designed for drilling hard formations are designed to roll as close as possible to a true roll, with little gouging or scrapping action. Offset will be zero and journal angles will be higher. Teeth are short and closely spaced to prevent breakage under the high loads. Drilling in hard formations is characterized by high weight and low rotary speeds.

Medium formations are drilled by combining the features of soft and hard formation bits. The rock is failed by combining compressive forces with limited shearing and gouging action that is achieved by designing drill bits with a moderate amount of offset. Tooth length is designed for medium extensions as well. Drilling in medium formations is most often done with weights and rotary speeds between that of the hard and soft formations.

Back Round: Roller Cone Bit Design

The "cones" in a roller cone bit need not be perfectly conical (nor perfectly frustroconical), but often have a slightly swollen axial profile. Moreover, the axes of the cones do not have to intersect the centerline of the borehole. (The angular difference is referred to as the "offset" angle.) Another variable is the angle by which the centerline of the bearings intersects the horizontal plane of the bottom of the hole, and this angle is known as the journal angle. Thus as the drill bit is rotated, the cones typically do not roll true, and a certain amount of gouging and scraping takes place. The gouging and scraping action is complex in nature, and varies in magnitude and direction depending on a number of variables.

Conventional roller cone bits can be divided into two broad categories: Insert bits and steel-tooth bits. Steel tooth bits are utilized most frequently in softer formation drilling, whereas insert bits are utilized most frequently in medium and hard formation drilling.

Steel-tooth bits have steel teeth formed integral to the cone. (A hard facing is typically applied to the surface of the teeth to improve the wear resistance of the structure.) Insert bits have very hard inserts (e.g. specially selected grades of tungsten carbide) pressed into holes drilled into the cone surfaces. The inserts extend outwardly beyond the surface of the cones to form the "teeth" that comprise the cutting structures of the drill bit.

The design of the component elements in a rock bit are interrelated (together with the size limitations imposed by the overall diameter of the bit), and some of the design parameters are driven by the intended use of the product. For example, cone angle and offset can be modified to increase or decrease the amount of bottom hole scraping. Many other design parameters are limited in that an increase in one parameter may necessarily result in a decrease of another. For example, increases in tooth length may cause interference with the adjacent cones.

Background: Tooth Design

The teeth of steel tooth bits are predominantly of the inverted "V" shape. The included angle (i.e. the sharpness of the tip) and the length of the tooth will vary with the design of the bit. In bits designed for harder formations the teeth will be shorter and the included angle will be greater. Gage row teeth (i.e. the teeth in the outermost row of the cone, next to the outer diameter of the borehole) may have a "T" shaped crest for additional wear resistance.

The most common shapes of inserts are spherical, conical, and chisel. Spherical inserts have a very small protrusion and are used for drilling the hardest formations. Conical inserts have a greater protrusion and a natural resistance to breakage, and are often used for drilling medium hard formations.

Chisel shaped inserts have opposing flats and a broad elongated crest, resembling the teeth of a steel tooth bit. Chisel shaped inserts are used for drilling soft to medium formations. The elongated crest of the chisel insert is normally oriented in alignment with the axis of cone rotation. Thus, unlike spherical and conical inserts, the chisel insert may be directionally oriented about its center axis. (This is true of any tooth which is not axially symmetric.) The axial angle of orientation is measured from the plane intersecting the center of the cone and the center of the tooth.

Background: Bottom Hole Analysis

The economics of drilling a well are strongly reliant on rate of penetration. Since the design of the cutting structure of a drill bit controls the bit's ability to achieve a high rate of penetration, cutting structure design plays a significant role in the overall economics of drilling a well.

It has long been desirable to predict the development of bottom hole patterns on the basis of the controllable geometric parameters used in drill bit design, and complex mathematical models can simulate bottom hole patterns to a limited extent. To accomplish this it is necessary to understand first, the relationship between the tooth and the rock, and second, the relationship between the design of the drill bit and the movement of the tooth in relation to the rock. It is also known that these mechanisms are interdependent.

To better understand these relationships, much work has been done to determine the amount of rock removed by a single tooth of a drill bit. As can be seen by the forgoing discussion, this is a complex problem. For many years it has been known that rock failure is complex, and results from the many stresses arising from the combined movements and actions of the tooth of a rock bit. (Sikarskie, et al, PENETRATION PROBLEMS IN ROCK MECHANICS, ASME Rock Mechanics Symposium, 1973). Subsequently, work was been done to develop quantitative relationships between bit design and tooth-formation interaction. This has been accomplished by calculating the vertical, radial and tangential movement of the teeth relative to the hole bottom, to accurately represent the gouging and scrapping action of the teeth on roller cone bits. (Ma, A NEW WAY TO CHARACTERIZE THE GOUGING-SCRAPPING ACTION OF ROLLER CONE BITS, Society of Petroleum Engineers No. 19448, 1989). More recently, computer programs have been developed which predict and simulate the bottom hole patterns developed by roller cone bits by combining the complex movement of the teeth with a model of formation failure. (Ma, THE COMPUTER SIMULATION OF THE INTERACTION BETWEEN THE ROLLER BIT AND ROCK, Society of Petroleum Engineers No. 29922, 1995). Such formation failure models include a ductile model for removing the formation occupied by the tooth during its movement across the bottom of the hole, and a fragile breakage model to represent the surrounding breakage.

Currently, roller cone bit designs remain the result of generations of modifications made to original designs. The modifications are based on years of experience in evaluating bit run records and dull bit conditions. Since drill bits are run under harsh conditions, far from view, and to destruction, it is often very difficult to determine the cause of the failure of a bit. Roller cone bits are often disassembled in manufacturers' laboratories, but most often this process is in response to a customer's complaint regarding the product, when a verification of the materials is required. Engineers will visit the lab and attempt to perform a forensic analysis of the remains of a rock bit, but with few exceptions there is generally little evidence to support their conclusions as to which component failed first and why. Since rock bits are run on different drilling rigs, in different formations, under different operating conditions, it is extremely difficult draw conclusion from the dull conditions of the bits. As a result, evaluating dull bit conditions, their cause, and determinig design solutions is a very subjective process. What is known is that when the cutting structure or bearing system of a drill bit fails prematurely, it can have a serious detrimental effect of the economics of drilling.

Though numerical methods are now available to model the bottom hole pattern produced by a roller cone bit, there is no suggestion as to how this should be used to improve the design of the bits other than to predict the presence of obvious problems such as tracking. For example, the best solution available for dealing with the problems of lateral vibration, is a recommendation that roller cone bits should be run at low to moderate rotary speeds when drilling medium to hard formations to control bit vibrations and prolong life, and to use downhole vibration sensors. (Dykstra, et al, EXPERIMENTAL EVALUATIONS OF DRILL STRING DYNAMICS, Amoco Report Number F94-P-80, 1994).

Force-Balanced Roller-Cone Bits, Systems, Drilling Methods, and Design Methods

The present application describes improved methods for designing roller cone bits, as well as improved drilling methods, and drilling systems. The present application teaches that roller cone bit designs should have equal mechanical downforce on each of the cones. This is not trivial: without special design consideration, the weight on bit will NOT automatically be equalized among the cones.

Roller-cone bits are normally NOT balanced, for several reasons:

Asymmetric cutting structures. Usually the rows on cones are intermeshed in order to cover fully the hole bottom and have a self-clearance effects. Therefore, even the cone shapes may be the same for all three cones, the teeth row distributions on cones are different from cone to cone. The number of teeth on cones are usually different. Therefore, the cone having more row and more teeth than other two cones may remove more rock and as a results, may spent more energy (Energy Imbalance). An energy imbalance usually leads to bit force imbalance.

Offset effects. Because of the offset, a scraping motion will be induced. This scraping motion is different from teeth row to teeth row and as a result, the scraping force (tangent force) acting on teeth is different from row to row. This will generate an imbalance force on bit.

Tracking effects. If at least one of the cones is in tracking, then this cone will gear with the hole bottom without penetration, the rock not removed by this cone will be partly removed by other two cones. As a result, the bit is unbalanced.

The applicant has discovered, and has experimentally verified, that equalization of downforce per cone is a very important (and greatly underestimated) factor in roller cone performance. Equalized downforce is believed to be a significant factor in reducing gyration, and has been demonstrated to provide substantial improvement in drilling efficiency. The present application describes bit design procedures which provide optimization of downforce balancing as well as other parameters.

A roller-cone bit will always be a strong source of vibration, due to the sequential impacts of the bit teeth and the inhomogeneities of the formation. However, many results of this vibration are undesirable. It is believed that the improved performance of balanced-downforce cones is partly due to reduced vibration.

Any force imbalance at the cones corresponds to a bending torque, applied to the bottom of the drill string, which rotates with the drill string. This rotating bending moment is a driving force, at the rotary frequency, which has the potential to couple to oscillations of the drill string. Moreover, this rotating bending moment may be a factor in biasing the drill string into a regime where vibration and instabilities are less heavily damped. It is believed that the improved performance of balanced-downforce cones may also be partly due to reduced oscillation of the drill string.

The disclosed innovations, in various embodiments, provide one or more of at least the following advantages:.

- The roller cone bit is force balanced such that axial loading between the arms is substantially equal.
- The roller cone bit is energy balanced such that each of the cutting structures drill substantially equal volumes of formation.
- The drill bit has decreased axial and lateral operating vibration.
- The cutting structures, bearings, and seals have increased lifetime and improved performance and durability.
- Drill string life is extended.
- The roller cone bit has minimized tracking of cutting structures, giving improved performance and extending cutting structure life.
- The roller cone bit has an optimized number of teeth in a given formation area.
- Bit performance is improved.
- Off-center rotation is minimized.
- The roller cone bit has optimized (minimized and equalized) uncut formation ring width.
- Energy balanced roller cone bits can be further optimized by minimizing cone and bit tracking.
- Energy balanced roller cone bits can be further optimized by minimizing and equalizing uncut formation rings.
- Designer can evaluate the force balance and energy balance conditions of existing bit designs.
- Designer can design force balanced drill bits with predictable bottom hole patterns without relying on lab tests followed by design modifications.
- Designer can optimize the design of roller cone drill bits within designer-chosen constraints.

Other advantages of the various disclosed inventions will become apparent from the following descriptions, taken in connection with the accompanying drawings, wherein, by way of illustration and example, a sample embodiment is disclosed.

U.S. patent application Ser. No. 09/387,304, filed Aug. 31, 1999, entided "Roller-Cone Bits, Systems, Drilling Methods, and Design Methods with Optimization of Tooth Orientation" (Atty. Docket No. SC-98-26), now U.S. Pat. No. 6,095,262 and claiming priority from U.S. Provisional Application No. 60/098,442 filed Aug. 31 1998, describes roller cone drill bit design methods and optimizations which can be used separately from or in synergistic combination with the methods disclosed in the present application. That application, which has common ownership, inventorship, and effective filing date with the present application, and its provisional priority application, are both hereby incorporated by reference.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

Rock Bit Computer Model

Figure 1:
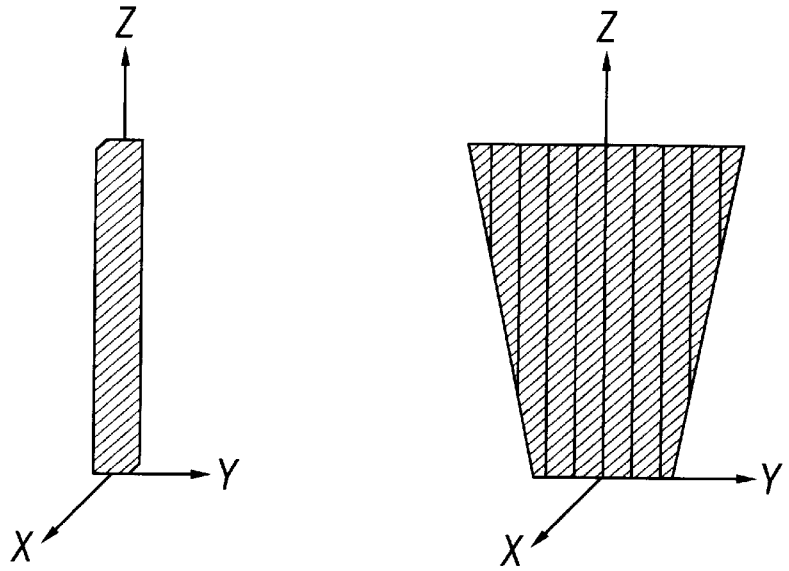
FIG. 1 shows an element and how the tooth is divided into elements for tooth force evaluation.

The present invention uses a single element force-cutting relationship in order to develop the total force-cutting relationship of a cone and of an entire roller cone bit. Looking at FIG. 1, each tooth, shown on the right side, can be thought of as composed of a collection of elements, such as are shown on the left side. Each element used in the present invention has a square cross section with area $S_e$ (its cross-section on the x-y plane) and length $L_e$ (along the z axis). The force-cutting relationship for this single element may be described by:

$$F_{ze}=K_e*\sigma*S_e \quad (1)$$

$$F_{xe}=\mu_x*F_{ze} \quad (2)$$

$$F_{ye}=\mu_y*F_{ze} \quad (3)$$

where $F_{ze}$ is the normal force and $F_{xe}$, $F_{ye}$ are side forces, respectively, $\sigma$ is the compressive strength, $S_e$ the cutting depth and $k_e$, $\mu_x$ and $\mu_y$ are coefficient associated with formation properties. These coefficients may be determined by lab test. A tooth or an insert can always be divided into several elements. Therefore, the total force on a tooth can be obtained by integrating equation (1) to (3). The single element force model used in the invention has significant advantage over the single tooth or single insert model used in most of the publications. The only way to obtain a force model is by lab test. There are many types of inserts used today for roller cone bit depending on the rock type drilled. If the single insert force model is used, a lot of tests have to be done and this is very difficult if not impossible. By using the element force model, only a few tests may be enough because any kind of insert or tooth can be always divided into elements. In other words, one element model may be applied to all kinds of inserts or teeth.

After having the single element force model, the next step is to determine the interaction between inserts and the formation drilled. This step involves the determination of the tooth kinematics (local) from the bit and cone kinematics (global) as described below.

(1) The bit kinematics is described by bit rotation speed, $\Omega$=RPM (revolutions per minute), and the rate of penetration, ROP. Both RPM and ROP may be considered as constant or as function with time.

(2) The cone kinematics is described by cone rotational speed. Each cone may have its own speed. The initial value is calculated from the bit geometric parameters or just estimated from experiment. In the calculation the cone speed may be changed based on the torque acting on the cone.

(3) At the initial time, t0, the hole bottom is considered as a plane and is meshed into small grids. The tooth is also meshed into grids (single elements). At any time t, the position of a tooth in space is fully determined. If the tooth is in interaction with the hole bottom, the hole bottom is updated and the cutting depth for each cutting element is calculated and the forces acting on the elements are obtained.

(4) The element forces are integrated into tooth forces, the tooth forces are integrated into cone forces, the cone forces are transferred into bearing forces and the bearing forces are integrated into bit forces.

(5) After the bit is fully drilled into the rock, these forces are recorded at each time step. A period time usually at least 10 seconds is simulated. The average forces may be considered as static forces and are used for evaluation of the balance condition of the cutting structure.

Evaluation of A Force Balanced Roller Cone Bit

Figure 2:
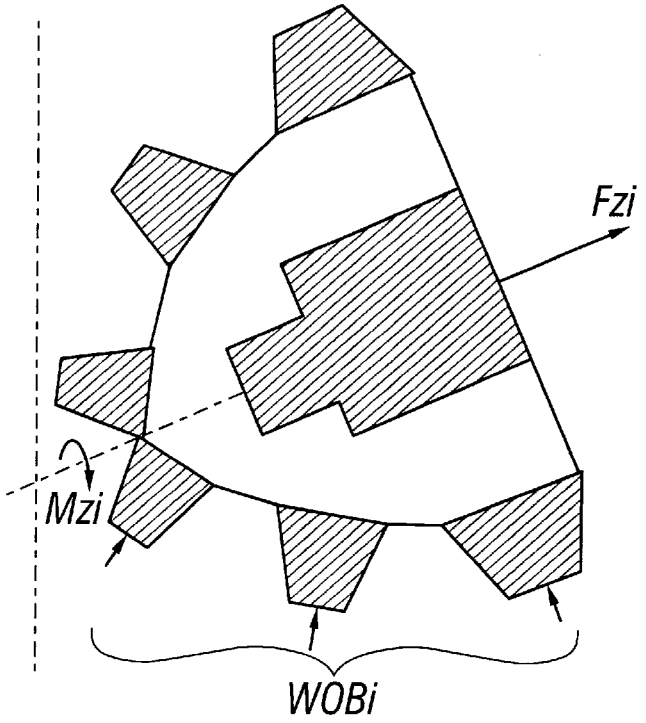
FIG. 2 diagrammatically shows a roller cone and the bearing forces which are measured in the current disclosure.

The applied forces to bit are the weight on bit (WOB) and torque on bit (TOB). These forces will be taken by three cones. Due to the asymmetry of bit geometry, the loads on three cones are usually not equal. In other words, one of the three cones may do much more work than other two cones. With reference to FIG. 2, the balance condition of a roller cone bit may be evaluated using the following criteria:

$$\mathrm{Max}(\omega1, \omega2, \omega3)-\mathrm{Min}(\omega1, \omega2, \omega3)<=\omega0 \quad (4)$$

$$\mathrm{Max}(\eta1, \eta2, \eta3)-\mathrm{Min}(\eta1, \eta2, \eta3)<=\eta0 \quad (5)$$

$$\mathrm{Max}(\lambda1, \lambda2, \lambda3)-\mathrm{Max}(\lambda1, \lambda2, \lambda3)<=\lambda0 \quad (6)$$

$$\xi=F_r/WOB*100\%<=\xi0 \quad (7)$$

where $\omega i$ (i=1,2,3) is defined by $\omega i$=WOBi/WOB*100%, WOBi is the weight on bit taken by cone i. $\eta i$ is defined by $\eta i$=Fzi/ΣFzi*100% with Fzi being the i-th cone axial force. And $\lambda i$ is defined by $\lambda i$=Mzi/ΣMzi*100% with Mzi being the i-th cone moment in the direction perpendicular to i-th cone axis. Finally $\xi$ is the bit imbalance force ratio with Fr being the bit imbalance force. A bit is perfectly balanced if:

$$\omega1=\omega2\ \omega=\omega3=33.333\% \text{ or } \omega=0.0\%$$

$$\eta1=\eta2=\eta3=33.333\% \text{ or } \eta0=0.0\%$$

$$\lambda1=\lambda2=\lambda3=33.333\% \text{ or } \lambda0=0.0\%$$

$$\xi=0.0\%$$

In most cases if $\omega0$, $\eta0$, $\lambda0$, $\xi0$ are controlled with some limitations, the bit is balanced. The values of $\omega0$, $\eta0$, $\lambda0$, $\xi0$ depend on bit size and bit type.

There is a distinction between force balancing techniques and energy balancing. A force balanced bit uses multiple objective optimization technology, which considers weight on bit, axial force, and cone moment as separate optimization objectives. Energy balancing uses only single objective optimization, as defined in equation (11) below.

Design of A Force Balanced Roller Cone Bit

As we stated in previous sections, there are many parameters which affect bit balance conditions. Among these parameters, the teeth crest length, their positions on cones (row distribution on cone) and the number of teeth play a significant role. An increase in the size of any one parameter must of necessity result in the decrease or increase of one or more of the others. And in some cases design rules may be violated. Obviously the development of optimization procedure is absolutely necessary.

Figure 3:
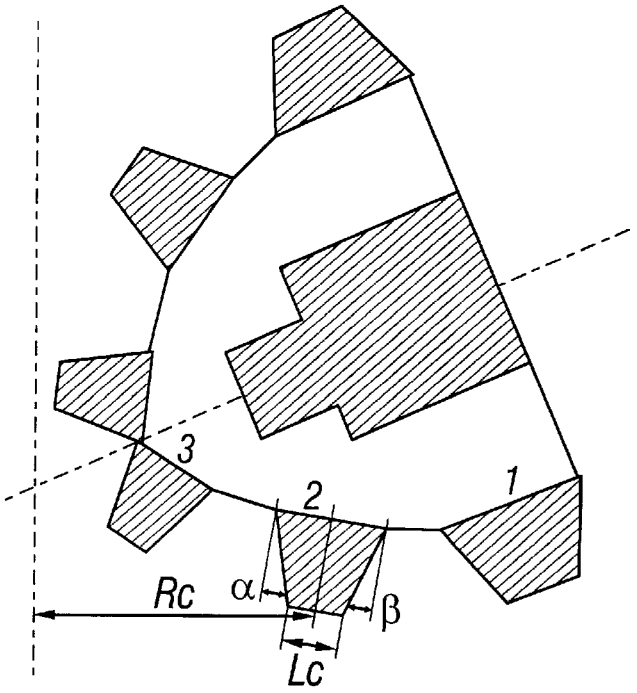
FIG. 3 shows the four design variables of a tooth on a cone.

The first step in the optimization procedure is to choose the design variables. Consider a cone of a steel tooth bit as shown in FIG. 3. The cone has three rows. For the sake of simplicity, the journal angle, the offset and the cone profile will be fixed and will not be as design variables. Therefore the only design variables for a row are the crest length, Lc, the radial position of the center of the crest length, Rc, and the tooth angles, $\alpha$ and $\delta$. Therefore, the number of design variables is 4 times of the total number of rows on a bit.

Figure 4:
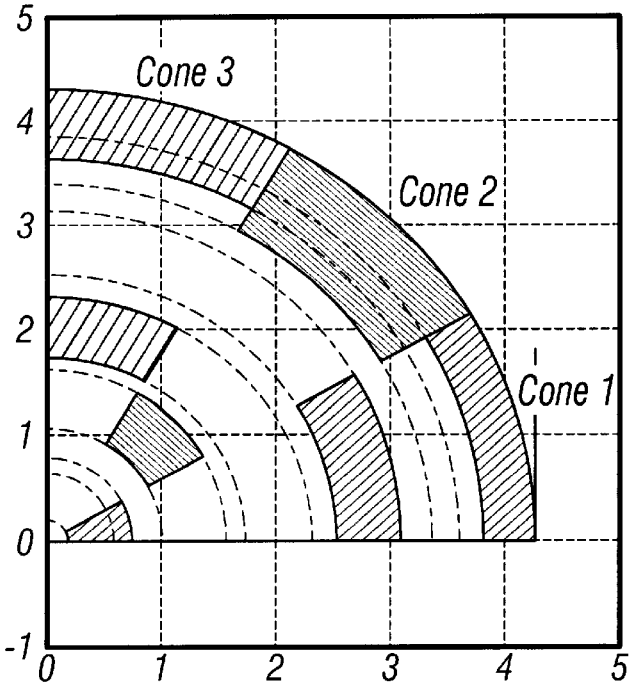
FIG. 4 shows the bottom hole pattern generated by a steel tooth bit.

The second step in the optimization procedure is to define the objectives and express mathematically the objectives as function of design variables. According to equation (1), the force acting on an element is proportional to the rock volume removed by that element. This principle also applies to any tooth. Therefore, the objective is to let each cone remove the same amount of rock in one bit revolution. This is called volume balance or energy balance. The present inventor has found that an energy balanced bit will lead to force balanced in most cases. Consider FIG. 4 which shows the patterns cut by each cone on the hole bottom. The first rows of all three cones have overlap and the inner rows remove the rock independently. Suppose the bit has a cutting depth $\Delta$ in one bit revolution. It is not difficult to calculate the volumes removed by each row and the volume matrix may have the form:

$$V=[V_{ij}],\ i=1,2,3;\ j=1,2,3,4, \quad (8)$$

where i represent the cone number andj the row number. For example, $V_{32}$ is the element in the volume matrix representing the rock volume removed by the second row of the third cone. The elements $V_{ij}$ of this matrix are all functions of the design variables.

In reality, the removed volume by each row depends not only on the above design variables, but also on the number of teeth on that row and the tracking condition. Therefore the volume matrix calculated in a 2D manner must be scaled. The scale matrix, $K_v$, may be obtained as follows.

$$K_v(ij)=V_{3d0}(ij)/V_{2d0}(i,j) \quad (9)$$

where $V_{3d0}$ is the volume matrix of the initial designed bit (before optimization). $V_{3d0}$ is obtained from the rock bit computer program by simulate the bit drilling procedure at least 10 seconds. $V_{2d0}$ is the volume matrix associated with the initial designed matrix and obtained using the 2D manner based on the bottom pattern shown in FIG. 4. The volume matrix has the final form:

$$V_b\ (i,j)=K(i,j)*V(i,j)=f_v(L_c, R_c, \alpha, \beta) \quad (10)$$

Figure 5:
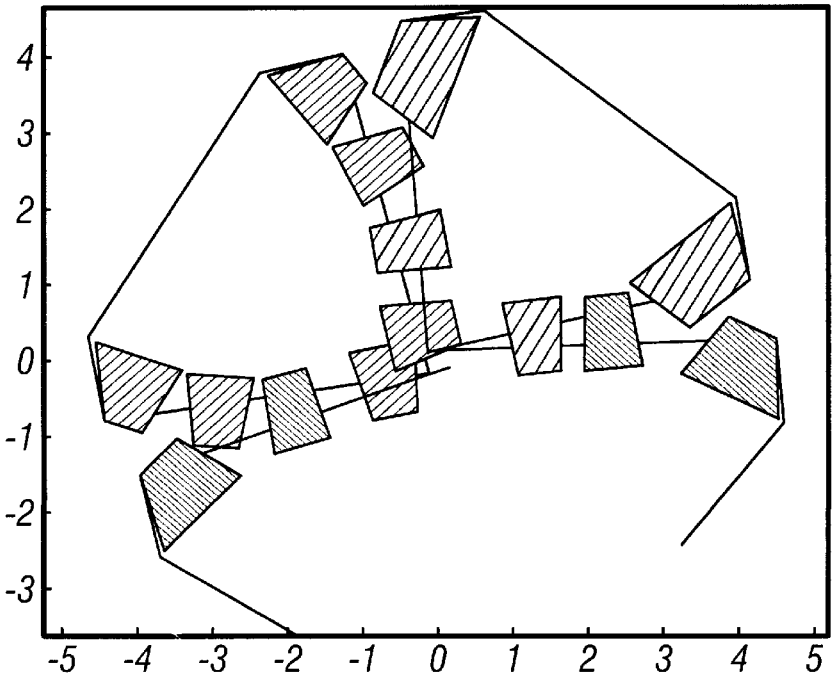
FIG. 5 shows the layout of row distribution in a plane showing the distance between any two tooth surfaces.

Let $V_1$, $V_2$ and $V_3$ be the volume removed by cone 1,2 and 3, respectively. For the energy balance, the objective function takes the following form:

$$Obj=(V_1-V_m)\hat{}2+(V_2-V_m)\hat{}2+(V_3-V_m)\hat{}2 \quad (11)$$

where $V_m=(V_1+V_2+V_3)/3$;

The third step in the optimization procedure is to defme the bounds of the design variables and the constraints. The lower and upper bounds of design variables can be determined by requirements on element strength and structural limitation. For example, the lower bound of a tooth crest length is determined by the tooth strength. The angle $\alpha$ and $\beta$ may be limited to 0~45 degrees. One of the most important constraints is the interference between teeth on different cones. A minimum -clearance between teeth surface must be kept. Consider FIG. 5 where cone profile is shown in a plane. A minimum clearance between tooth surfaces is required. This clearance can be expressed as a function of the design variables.

$$\Delta d=f_d(L_c, R_c, \alpha, \beta) \quad (12)$$

Another constraint is the width of the uncut formation rings on bottom. The width of the uncut formation rings should be minimized or equalized in order to avoid the direct contact of cone surface to formation drilled. These constraints can be expressed as:

$$\Delta w_{min}<=\Delta wi=fw_i(L_c, R_c, \alpha, \beta)<=\Delta w_{max} \quad (13)$$

There may be other constraints, for example, the minimum space between two neighbored rows on the same cone required by the mining process.

Figure 6:
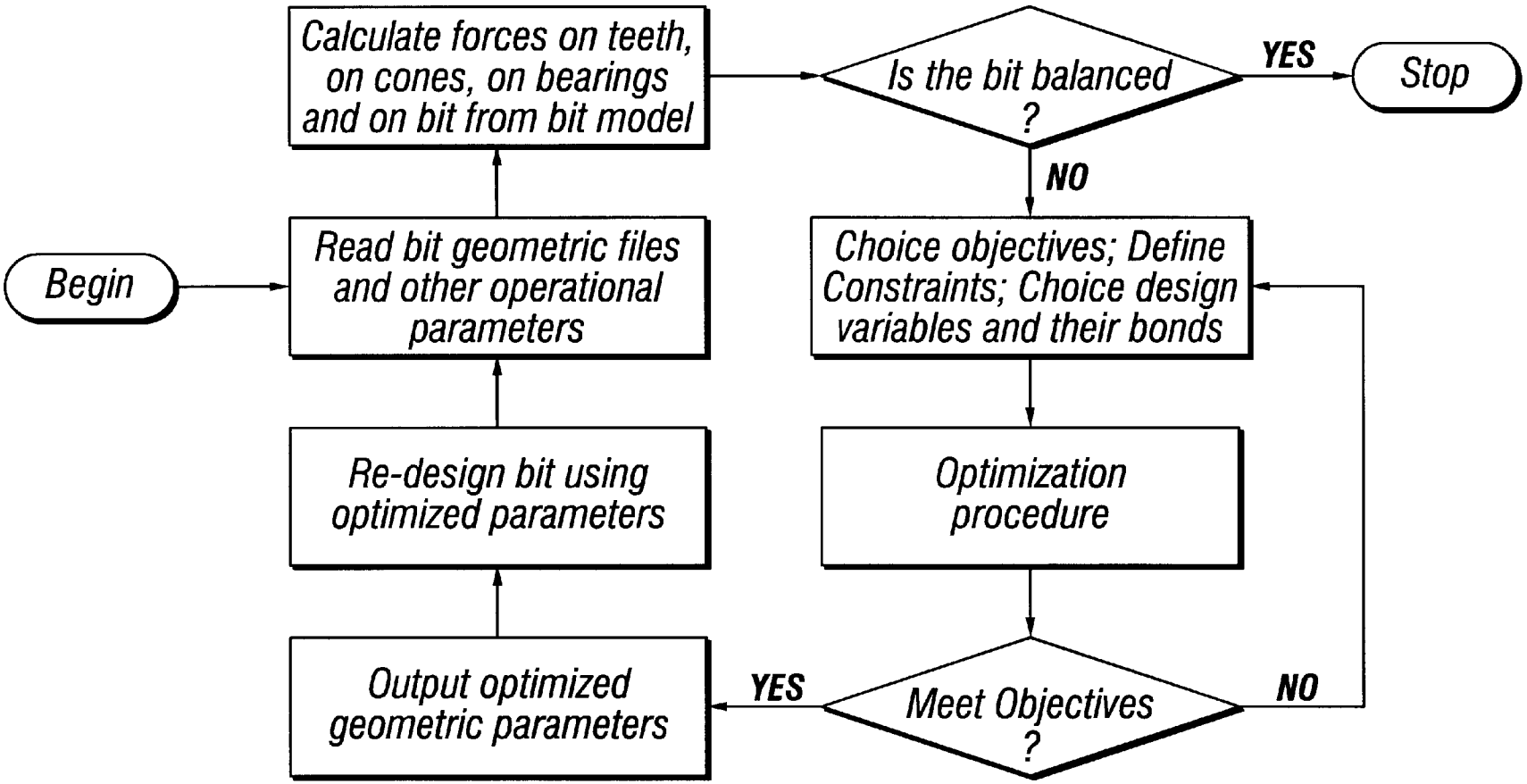
FIG. 6 shows a flowchart of the optimization procedure to design a force balanced bit.

After having the objective function, the bounds and the constraints, the problem is simplified to a general nonlinear optimization problem with bounds and nonlinear constraints which can be solved by different methods. FIG. 6 shows the flowchart of the optimization procedure. The procedure begins by reading the bit geometry and other operational parameters. The forces on the teeth, cones, bearings, and bit are then calculated. Once the forces are known, they are compared, and if they are balanced, then the design is optimized. If the forces are not balanced, then the optimization must occur. Objectives, constraints, design variables and their bounds (maximum and minimum allowed values) are defined, and the variables are altered to conform to the new objectives. Once the new objectives are met, the new geometric parameters are used to redesign the bit, and the forces are again calculated and checked for balance. This process is repeated until the desired force balance is achieved.

Figure 7C:
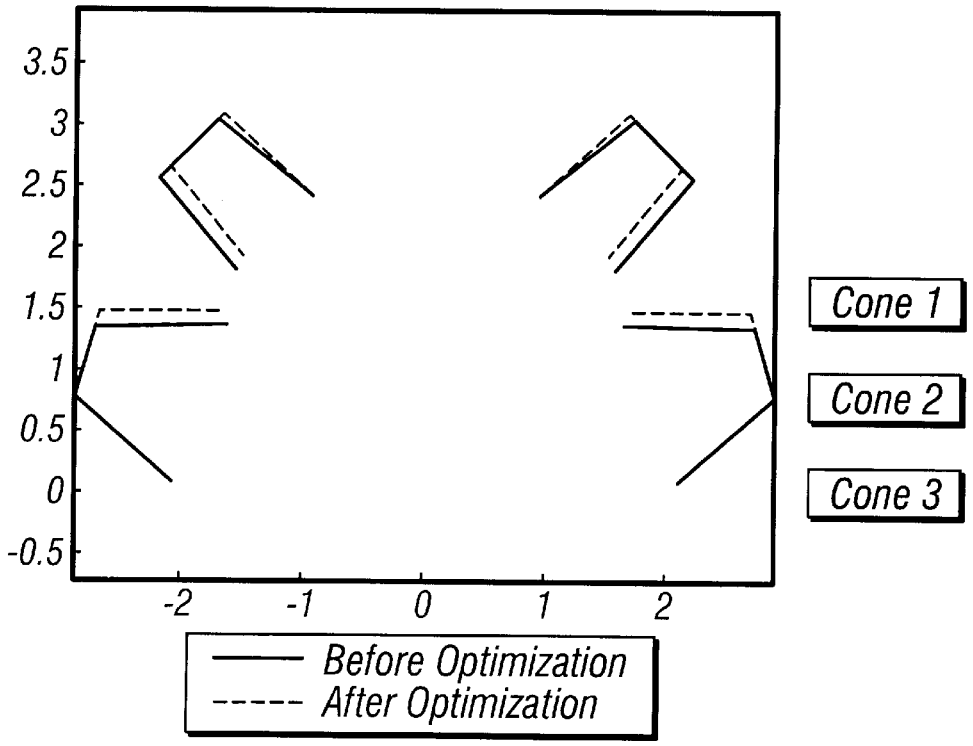
FIGS. 7A–C compare the three cone profiles before and after optimization.
Figure 7A:
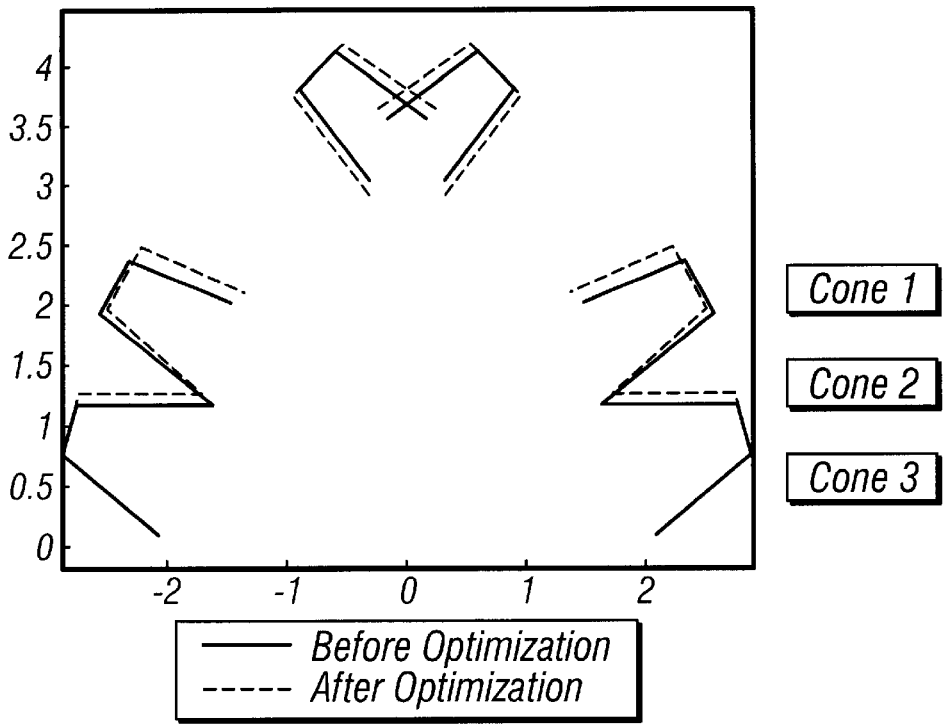
Figure 7B:
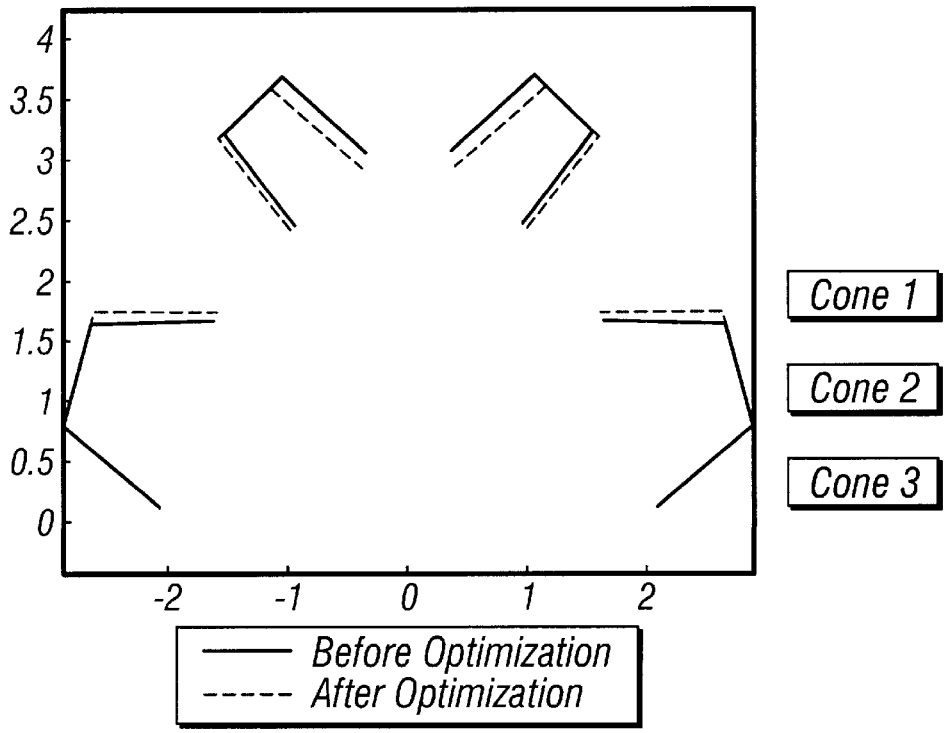
Figure 8A:
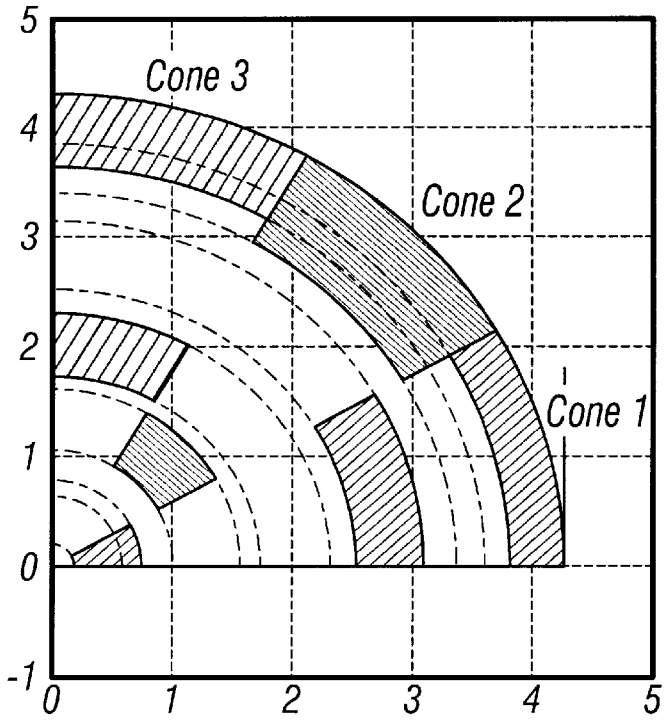
FIGS. 8A–B compare the bottom hole pattern before and after optimization.
Figure 8B:
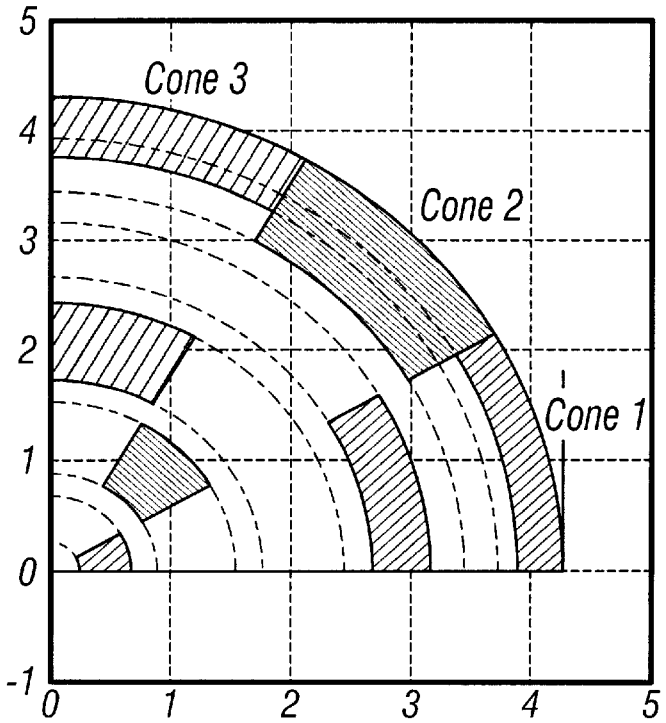
Figure 9A:
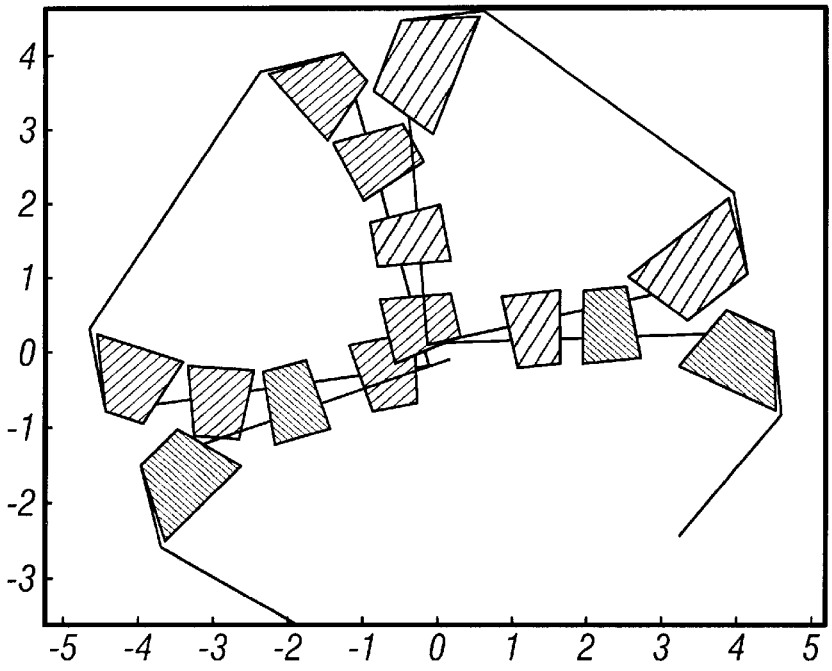
FIGS. 9A–B compare the cone layout before and after optimization.
Figure 9B:
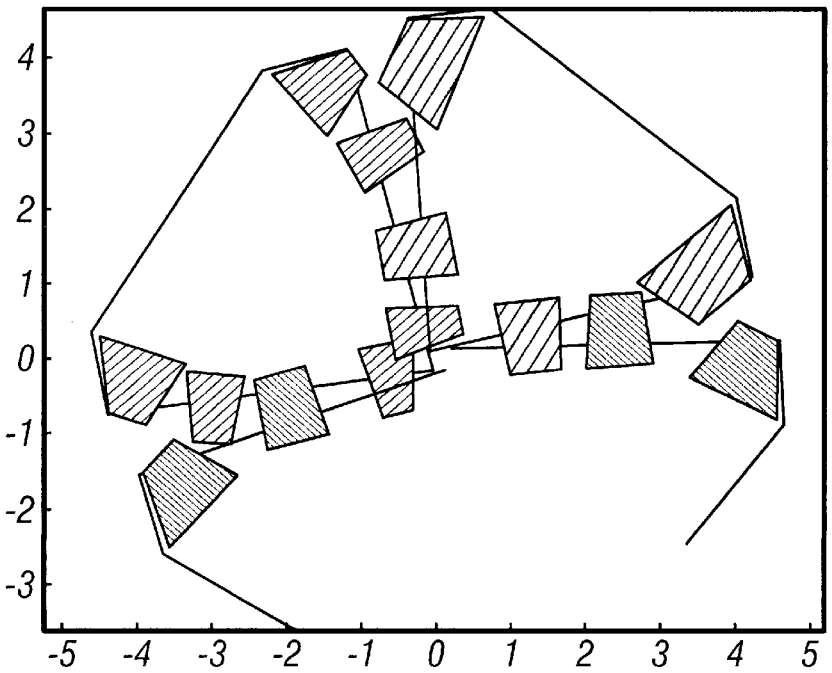
Figure 10:
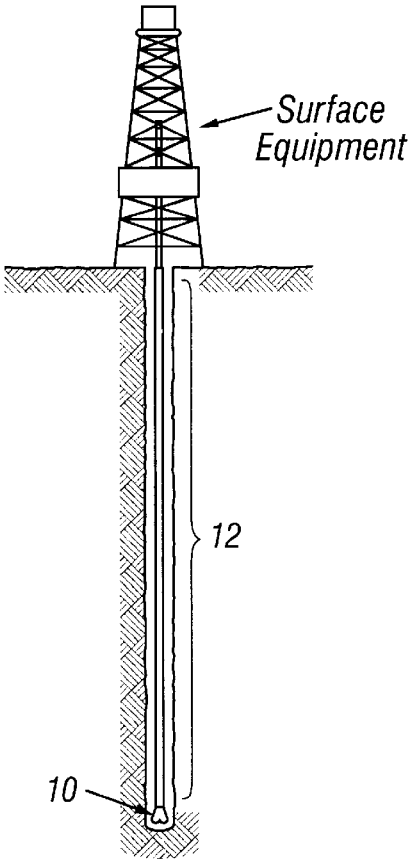
FIG. 10 shows an example of a drill rig which can use bits designed by the disclosed method.
Figure 11:
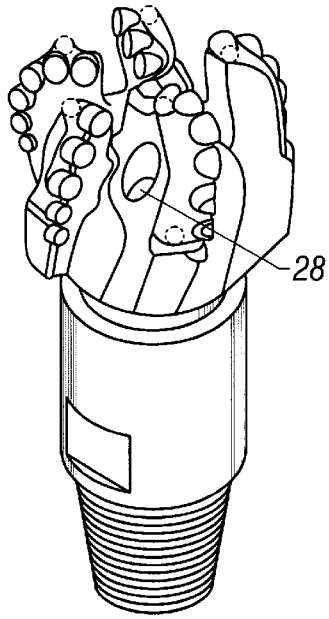
FIG. 11 shows an example of a roller cone bit.
Figure 12:
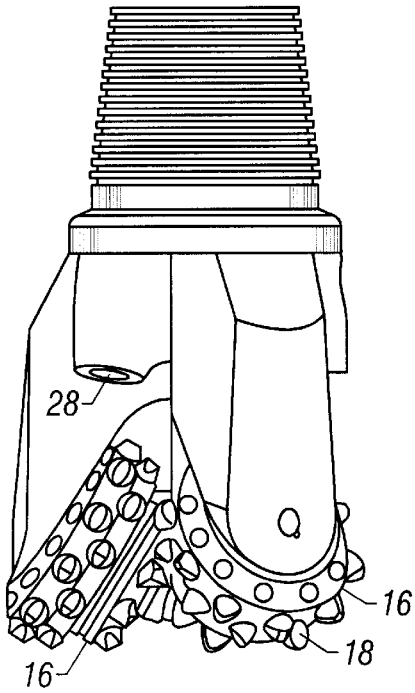
FIG. 12 shows an example of a drag bit.

As an example, FIGS. 7A–C show the row distributions on three cones of a 9" steel tooth bit before and after optimization. FIGS. 8A and 8B compare the bottom hole patterns cut by the different cones before and after optimization. FIGS. 9A and B compare the cone layouts before and after optimization.

In the preferred embodiment of the present disclosure, a roller cone bit is provided for which the volume of formation removed by each tooth in each row, of each cutting structure (cone), is calculated. This calculation is based on input data of bit geometry, rock properties, and operational parameters. The geometric parameters of the roller cone bit are then modified such that the volume of formation removed by each cutting structure is equalized. Since the amount of formation removed by any tooth on a cutting structure is a function of the force imparted on the formation by the tooth, the volume of formation removed by a cutting structure is a direct function of the force applied to the cutting structure. By balancing the volume of formation removed by all cutting structures, force balancing is also achieved.

As another feature of the preferred embodiment, a roller cone bit is provided for which the width of the rings of formation remaining uncut is calculated, as it remains between the rows of the intermeshing teeth of the different cutting structures. The geometric parameters of the roller cone bit are then modified such that the width of the uncut area for each row is substantially minimized and equalized within selected acceptable limits. By minimizing the uncut rings on the bottom of the hole, the bit will be able to crush the uncut rings upon successive rotations due to the craters of formation removed immediately adjacent to the uncut rings. By equalizing the width of the uncut rings, the force required to crush the rings will be even from any point on the hole face, such that as cutting elements (teeth) engage the rings on successive rotations, the rings act to uniformly retain the bit drilling on-enter.

According to a disclosed class of innovative embodiments, there is provided: A roller cone drill bit comprising: a plurality of arms; rotatable cutting structures mounted on respective ones of said arms; and a plurality of teeth located on each of said cutting structures; wherein approximately the same axial force is acting on each of said cutting structure.

According to another disclosed class of innovative embodiments, there is provided: A roller cone drill bit comprising: a plurality of arms; rotatable cutting structures mounted on respective ones of said arms; and a plurality of teeth located on each of said cutting structures; wherein a substantially equal volume of formation is drilled by each said cutting structure.

According to another disclosed class of innovative embodiments, there is provided: A rotary drilling system, comprising: a drill string which is connected to conduct drilling fluid from a surface location to a rotary drill bit; a rotary drive which rotates at least part of said drill string together with said bit said rotary drill bit comprising a plurality of arms; rotatable cutting structures mounted on respective ones of said arms; and a plurality of teeth located on each of said cutting structures; wherein approximately the same axial force is acting on each said cutting structure.

According to another disclosed class of innovative embodiments, there is provided: A method of designing a roller cone drill bit, comprising the steps of: (a) calculating the volume of formation cut by each tooth on each cutting structure; (b) calculating the volume of formation cut by each cutting structure per revolution of the drill bit; (c) comparing the volume of formation cut by each of said cutting structures with the volume of formation cut by all others of said cutting structures of the bit; (d) adjusting at least one geometric parameter on the design of at least one cutting structure; and (e) repeating steps (a) through (d) until substantially the same volume of formation is cut by each of said cutting structures of said bit.

According to another disclosed class of innovative embodiments, there is provided: A method of designing a roller cone drill bit, the steps of comprising: (a) calculating the axial force acting on each tooth on each cutting structure; (b) calculating the axial force acting on each cutting structure per revolution of the drill bit; (c) comparing the axial force acting on each of said cutting structures with the axial force on the other ones of said cutting structures of the bit; (d) adjusting at least one geometric parameter on the design of at least one cutting structure; (e) repeating steps (a) through (d) until approximately the same axial force is acting on each cutting structure.

According to another disclosed class of innovative embodiments, there is provided: A method of designing a roller cone drill bit, the steps of comprising: (a) calculating the force balance conditions of a bit; (b) defining design variables; (c) determine lower and upper bounds for the design variables; (d) defining objective functions; (e) defining constraint functions; (f) performing an optimization means; and, (g) evaluating an optimized cutting structure by modeling.

According to another disclosed class of innovative embodiments, there is provided: A method of using a roller cone drill bit, comprising the step of rotating said roller cone drill bit such that substantially the same volume of formation is cut by each roller cone of said bit.

According to another disclosed class of innovative embodiments, there is provided: A method of using a roller cone drill bit, comprising the step of rotating said roller cone drill bit such that substantially the same axial force is acting on each roller cone of said bit.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

Additional general background, which helps to show the knowledge of those skilled in the art regarding implementations and the predictability of variations, may be found in the following publications, all of which are hereby incorporated by reference: APPLIED DRILLING ENGINEERING, Adam T. Bourgoyne Jr. et aL, Society of Petroleum Engineers Textbook series (1991), OIL AND GAS FIELD DEVELOPMENT TECHNIQUES: DRILLING, J.-P. Nguyen (translation 1996, from French original 1993), MAKING HOLE (1983) and DRILLING MUD (1984), both part of the Rotary Drilling Series, edited by Charles Kirkley.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

What is claimed is:

1. A roller cone drill bit comprising:

a plurality of arms;

rotatable cutting structures mounted on respective ones of said arms; and a plurality of teeth located on each of said cutting structures, wherein the number and locations of said teeth are not identical between ones of said rotatable cutting structures;

wherein approximately the same axial force is acting on each of said cutting structure.

2. The roller cone drill bit of claim 1, wherein the axial force on each of said cutting structure is between thirty-one (31) percent and thirty-five (35) percent of the total of the axial force on the bit.

3. A roller cone drill bit comprising:

a plurality of arms;

rotatable cutting structures mounted on respective ones of said arms; and a plurality of teeth located on each of said cutting structures, wherein the number and locations of said teeth are not identical between ones of said rotatable cutting structures;

wherein a substantially equal volume of formation is drilled by each said cutting structure.

4. The roller cone drill bit of claim 3, wherein the volume of formation drilled by each of said cutting structures is between thirty-one (31) percent and thirty-five (35) percent of the total volume drilled by the drill bit.

5. A rotary drilling system, comprising:

a drill string which is connected to conduct drilling fluid from a surface location to a rotary drill bit;

a rotary drive which rotates at least part of said drill string together with said bit said rotary drill bit comprising a plurality of arms;

rotatable cutting structures mounted on respective ones of said arms; and a plurality of teeth located on each of said cutting structures, wherein the number and locations of said teeth are not identical between ones of said rotatable cutting structures;

wherein approximately the same axial force is acting on each of said cutting structure.

6. A method of designing a roller cone drill bit, comprising the steps of:

(a) calculating the volume of formation cut by each tooth on each cutting structure;

(b) calculating the volume of formation cut by each cutting structure per revolution of the drill bit;

(c) comparing the volume of formation cut by each of said cutting structures with the volume of formation cut by all others of said cutting structures of the bit;

(d) adjusting at least one geometric parameter on the design of at least one cutting structure; and (e) repeating steps (a) through (d) until substantially the same volume of formation is cut by each of said cutting structures of said bit.

7. The method of claim 6, wherein the step of calculating the volume of formation cut by each tooth on each cutting structure further comprises the step of using numerical simulation to determine the interval progression of each tooth as it intersects the formation.

8. A method of designing a roller cone drill bit, the steps of comprising:

(a) calculating the axial force acting on each tooth on each cutting structure;

(b) calculating the axial force acting on each cutting structure per revolution of the drill bit;

(c) comparing the axial force acting on each of said cutting structures with the axial force on the other ones of said cutting structures of the bit;

(d) adjusting at least one geometric parameter on the design of at least one cutting structure;

(e) repeating steps (a) through (d) until approximately the same axial force is acting on each cutting structure.

9. The method of claim 8, wherein the step of calculating the normal force acting on each tooth, on each cutting structure further comprises the step of using numerical simulation to determine the interval progression of each tooth as it intersects the formation.

10. The method of claim 8, further comprising the steps of:

(a) calculating the volume of formation displaced by the depth of penetration of each tooth;

(b) calculating the volume of formation displaced by the tangential scrapping movement of each tooth;

(c) calculating the volume of formation displaced by the radial scrapping movement of each tooth; and, (d) calculating the volume of formation displaced by a crater enlargement parameter function.

11. A method of using a roller cone drill bit which has at least two roller cones which are not identical to each other, comprising the step of rotating said roller cone drill bit such that substantially the same volume of formation is cut by each roller cone of said bit.

12. A method of using a roller cone drill bit which has at least two roller cones which are not identical to each other, comprising the step of rotating said roller cone drill bit such that substantially the same axial force is acting on each roller cone of said bit.

* * * * *